US005867901A

United States Patent [19]

Noda et al.

[11] Patent Number: 5,867,901

[45] Date of Patent: Feb. 9, 1999

[54] METHOD FOR PRODUCING A BEVEL GEAR SHAFT

[75] Inventors: Katsunori Noda; Kazuaki Okajima, both of Kyoto, Japan

[73] Assignee: Nichidai Corporation, Kyoto, Japan

[21] Appl. No.: 587,562

[22] PCT Filed: May 21, 1992

[86] PCT No.: PCT/JP92/00675

§ 371 Date: Jan. 18, 1994

§ 102(e) Date: Jan. 18, 1994

[87] PCT Pub. No.: WO93/23186

PCT Pub. Date: Nov. 25, 1993

Related U.S. Application Data

[63] Continuation of Ser. No. 185,959, Jan. 18, 1994, abandoned.

[51] Int. Cl.[6] ..... B21D 28/00

[52] U.S. Cl. ..... 29/893.34; 29/893.3

[58] Field of Search ..... 29/893.3, 893.33, 29/893.34; 72/355.6, 356

[56] References Cited

U.S. PATENT DOCUMENTS 3,780,413 12/1973 Burgdorf ..... 29/893.3

FOREIGN PATENT DOCUMENTS 3614619 8/1987 Germany ..... 29/893.33
46-2176 1/1971 Japan .
49-102038 9/1974 Japan .
60-184444 9/1985 Japan .
61-235033 10/1986 Japan .
62-91051 6/1987 Japan .

*Primary Examiner*—P. W. Echols
*Attorney, Agent, or Firm*—Jordan and Hamburg

[57] ABSTRACT

A method for producing a bevel gear shaft, adaptable to produce a shaft having a desired recess shape, such as an involute spline, in the longitudinal direction. A blank, having a bevel gear portion complementary to an upper die and a shaft portion small enough to fit into a lower die, is utilized in the process. The product is formed to the shape of upper and lower dies held together in a press. An upper punch passes downward through the upper die and a lower punch passes upward through the lower die. The punches displace some of the raw material of the blank forcing it to bulge and take on the shape of the upper and lower dies. The bevel gear portion may be coined by the upper die simultaneously with the forging of the bevel gear shaft. The invention shortens production time, increases product strength, and improves product yield per unit weight of raw material.

5 Claims, 8 Drawing Sheets

METHOD FOR PRODUCING A BEVEL GEAR SHAFT

This is a continuation of application Ser. No. 08/185,959, now abandoned filed on Priority of application Ser. No. PCT/JP/92/00675 filed on May 21, 1992 is claimed under 35 U.S.C. 119.

BACKGROUND OF THE INVENTION GROUP 3200

The present invention relates to methods for forming bevel gear shafts. In particular, the present invention relates to a method for forming a bevel gear shaft having a desired recess shape, such as an involute spline, in its longitudinal direction.

Known methods for producing bevel gear shafts are useful for a variety of applications. The methods can be applied to the production of drive pinions on limited slip differential gears. For example, referring to FIG. 7 of the present invention, a bevel gear I having an involute spline 2 is utilized as a driving pinion on a limited slip differential gear.

Conventionally, when manufacturing bevel gear shafts, involute spline 2 is produced by a material removal process such as machining. The main disadvantages of material removal processes are low productivity and decreased mechanical strength. Forming involute spline 2 by machining requires 1–5 minutes and the resulting structure has only 75–80% of the mechanical strength of the same structure formed by forging. This lower mechanical strength of machined -vs- forged structures is known to be due to the interruption of the stabilized grain structure by the shearing action of the machining process.

Referring now to FIG. 8, when the involute spline is produced on a bevel gear shaft by conventional forging techniques, a shoulder 4 and an approach angle 5 are required for guiding the blank into the die, for stabilizing it during the punching process, and for drawing the shaft in the bevel gear. Therefore, forging an involute spline on the entire length of the shaft with no shoulder 4 and no approach angle 5, as in FIG. 7., cannot be accomplished with a conventional die forging process.

Referring now to FIG. 9, involute splines 2 can be formed before producing bevel gear portion 3. However, in order to make the involute spline fit smoothly in a gear die, the involute spline is required to be of smaller dimension than gear die. Moreover, in the next step the involute spline is required to be uniformly enlarged. It is impossible to accurately enlarge the spline uniformly. Furthermore, with this process a protruding portion 6 is produced in forming the bevel gear portion, thereby reducing the yield rate.

OBJECTS AND SUMMARY OF THE INVENTION

It is an object of the present invention to overcome the drawbacks of the prior art by producing a bevel gear formed entirely by forging.

To overcome the drawbacks of the prior art, it is a further object of the present invention to provide a method for forging an involute spline on a bevel gear shaft which shortens manufacturing time, increases yield per unit material, and improves product strength.

In a first embodiment of the first invention there is provided a method for producing a bevel gear shaft. An upward pressure by a lower punch creates a desired bulging portion, such as an involute spline, on a bevel gear which has a bevel gear portion previously formed by a machining or forging process. The preformed bevel gear portion is blocked to prevent damage to the bevel gear while forging the shaft. Thus the involute spline can be produced on the entire length of the bevel gear shaft at a high rate of yield, and in a short period of time.

In a second embodiment of the present invention there is provided a method for producing a bevel gear shaft wherein the upper and lower dies, as a unit, sink downward around a stationary lower punch. The pressure between the lower punch and the workpiece, generated by the sinkage rate of the downward moving upper and lower die unit, creates a desired bulging portion on the shaft of a bevel gear blank. At the same time, the bevel gear portion is also coined. Accordingly, it is possible to recoin the bevel gear portion exactly, even if the bevel gear used as a blank has different dimensions from the final specification. Using this method the involute spline can be accurately produced on the entire length of the bevel gear shaft with a high yield rate and a short manufacturing time.

In both embodiments it is possible for the configurations to be inverted with respect to either the orientation of the die and punches, or to the orientation of the bevel gear and shaft. Also, the process of forming the involute spline does not preclude simultaneously coining the bevel gear portion. Accordingly, it is possible to reform the bevel gear portion to a new configuration or higher standard in those cases where the preformed bevel gear has different dimensions than those of the die.

Mechanical strength of the bevel gear produced using these methods increases 20–30% over conventional gears, because the grain structure in the metal is protected from disruption by machining. There is also a 7% improvement in material yield. Finally the production time per unit is decreased from 1–5 minutes per unit to 4 seconds per unit.

DETAILED DESCRIPTION OF THE PREFERRED EMBODIMENTS

Figure 1:
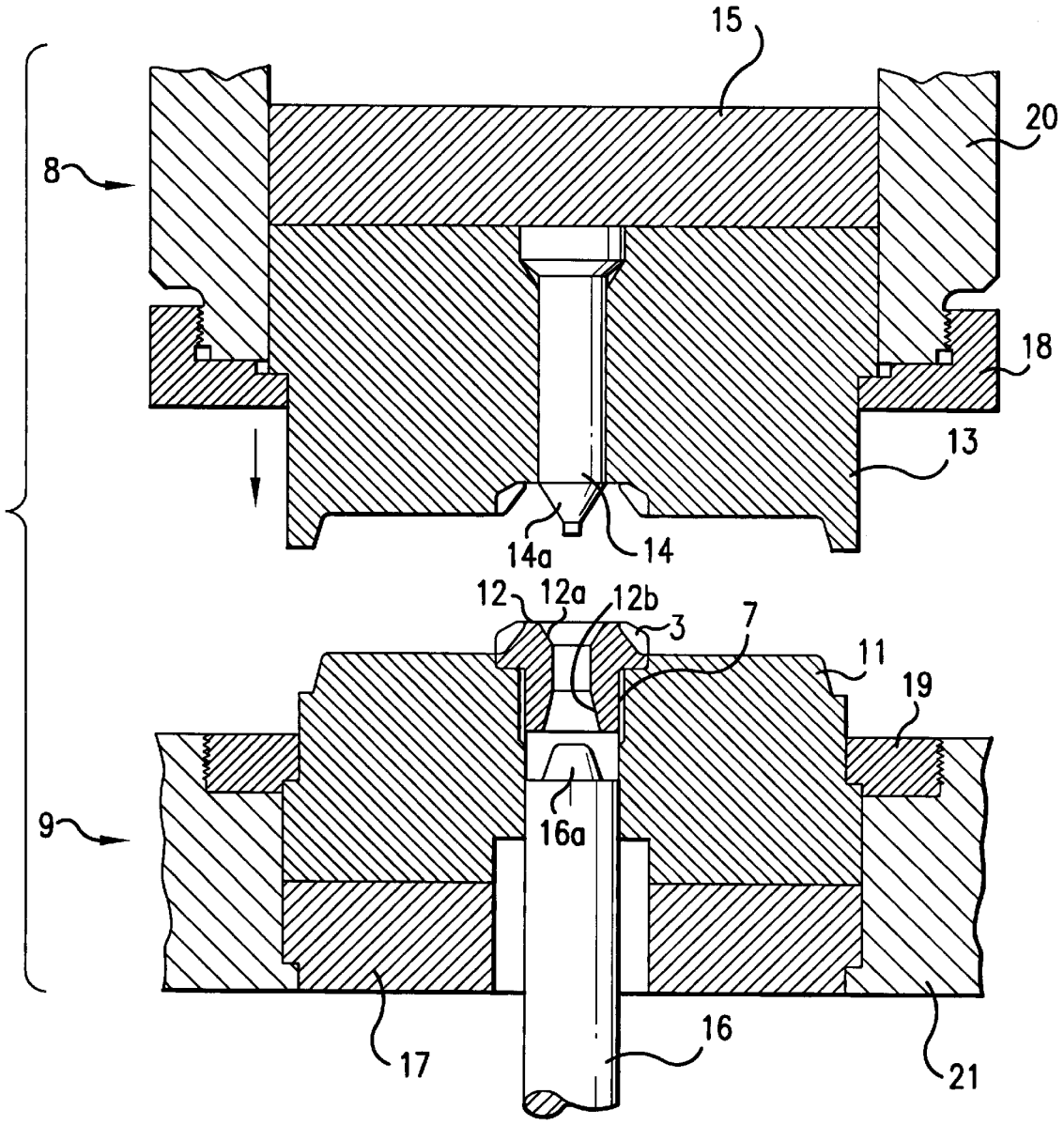
FIGS. 1–3 are cross-sections illustrating the sequence of steps for forging a bevel gear by a first method. The bevel gear before forging is shown in FIG. 1, the bevel gear during forging is shown in FIG. 2, and the bevel gear after forging is shown in FIG. 3.

Referring generally to FIGS. 1–6, the process of the present invention utilizes a double die press having an upper die holder 20 and a lower die holder 21. An upper die 13, placed in upper die holder 20, is held in position against an upper plate 15 by threaded retaining ring 18. An upper punch 14, passes centrally through upper die 13 and is fixedly captured therein by upper plate 15. A lower die 11 is fixed within lower die holder 21 against a lower plate 17 by threaded retaining ring 19. A lower punch 16 passes centrally through both lower die 11 and lower plate 17.

Referring to FIG. I a work piece 12 is oriented with a previously formed bevel gear portion 3 facing upward. A shaft portion 7 of work piece 12 fits into lower die 11. Lower die 11, in this example, contains the spline forming architecture while upper die 13 is formed in a shape complementary to bevel gear 3. FIG. I shows this arrangement with work piece 12 in place but before the press is activated.

Figure 2:
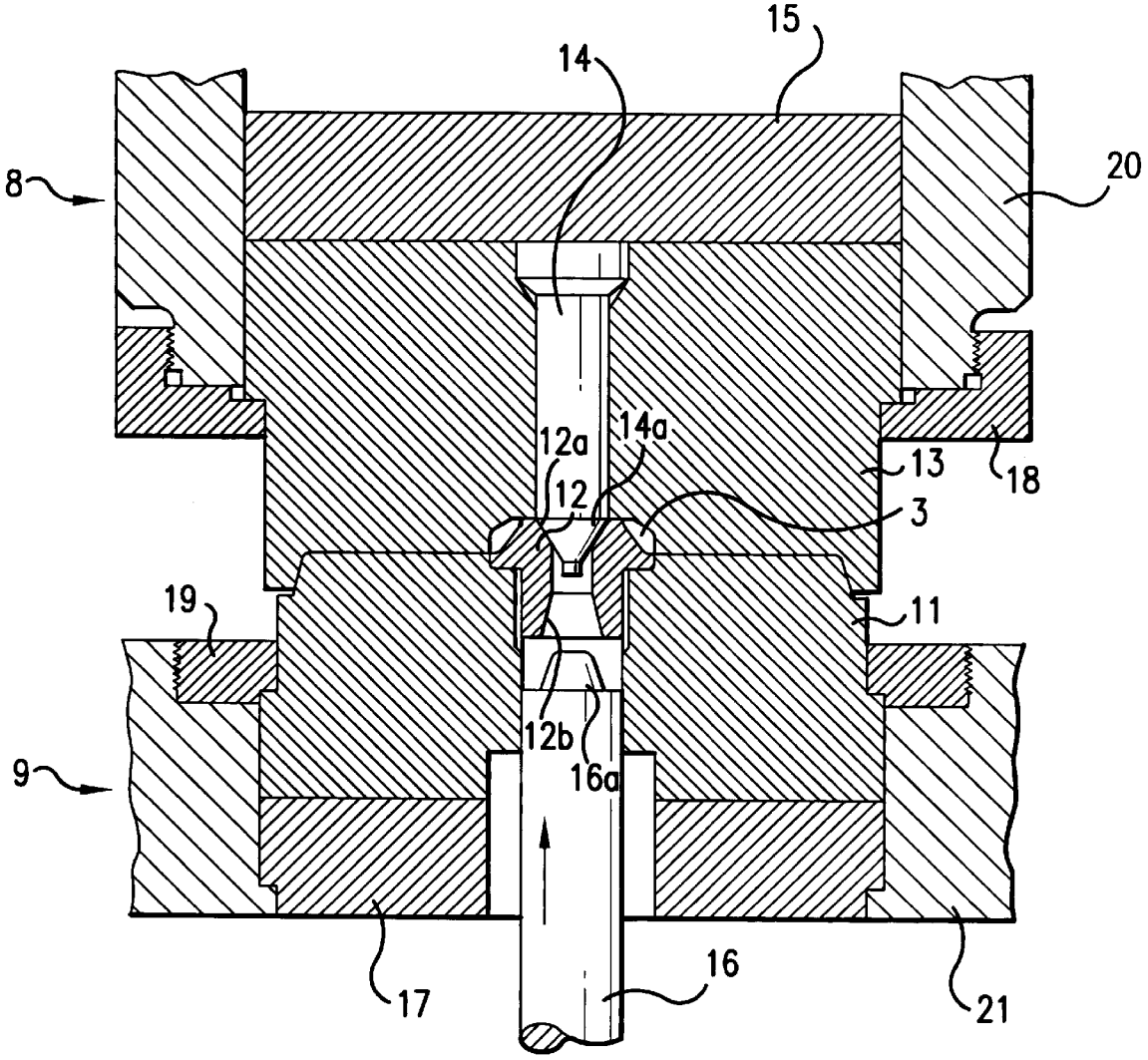

Referring to FIG. 2, the press sequence is activated and the forging process is in progress. Upper die assembly 8 is lowered to contact lower die assembly 9. Work piece 12 is in high pressure contact with upper die 13 and a conical surface 14*a* of upper punch 14 is exerting a deforming pressure on an upper inner conical surface 12*a* of work piece 12. The high pressure contact of upper die 13 with work piece 12 causes bevel gear portion 3 to be coined or prevents deformation thereof.

Figure 3:
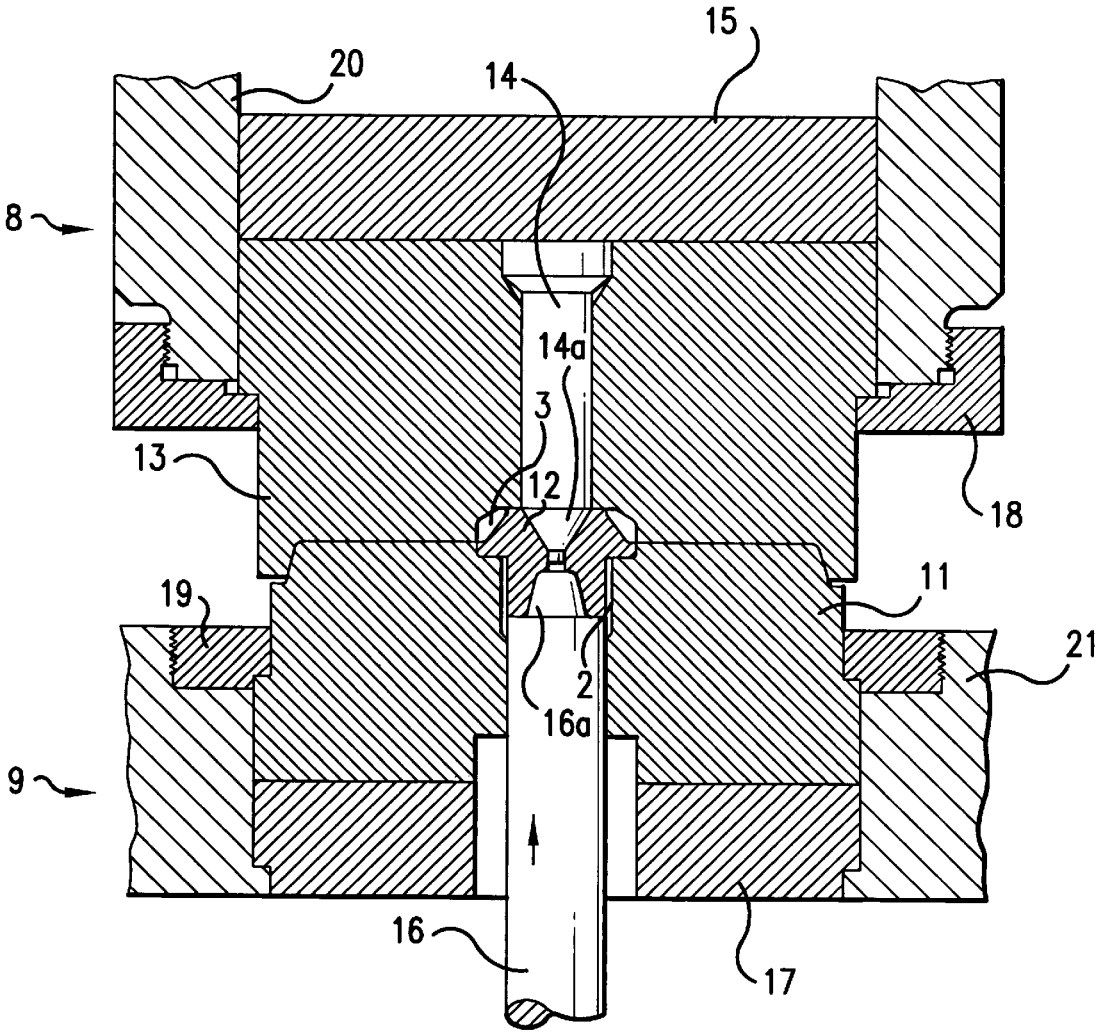

Referring now to FIG. 3, lower punch 16, having a conical surface 16*a*, is actuated to contact an inner conical surface 12*b* of work piece 12 and a second deforming pressure is exerted thereon. This second deforming pressure causes the material of work piece 12 to flow outward and fill all the voids of lower die 11, thereby forming the involute splines on the shaft of work piece 12. Excess raw material can flow into a void in the blank between upper punch 14 and lower punch 16 to relieve the load.

Figure 4:
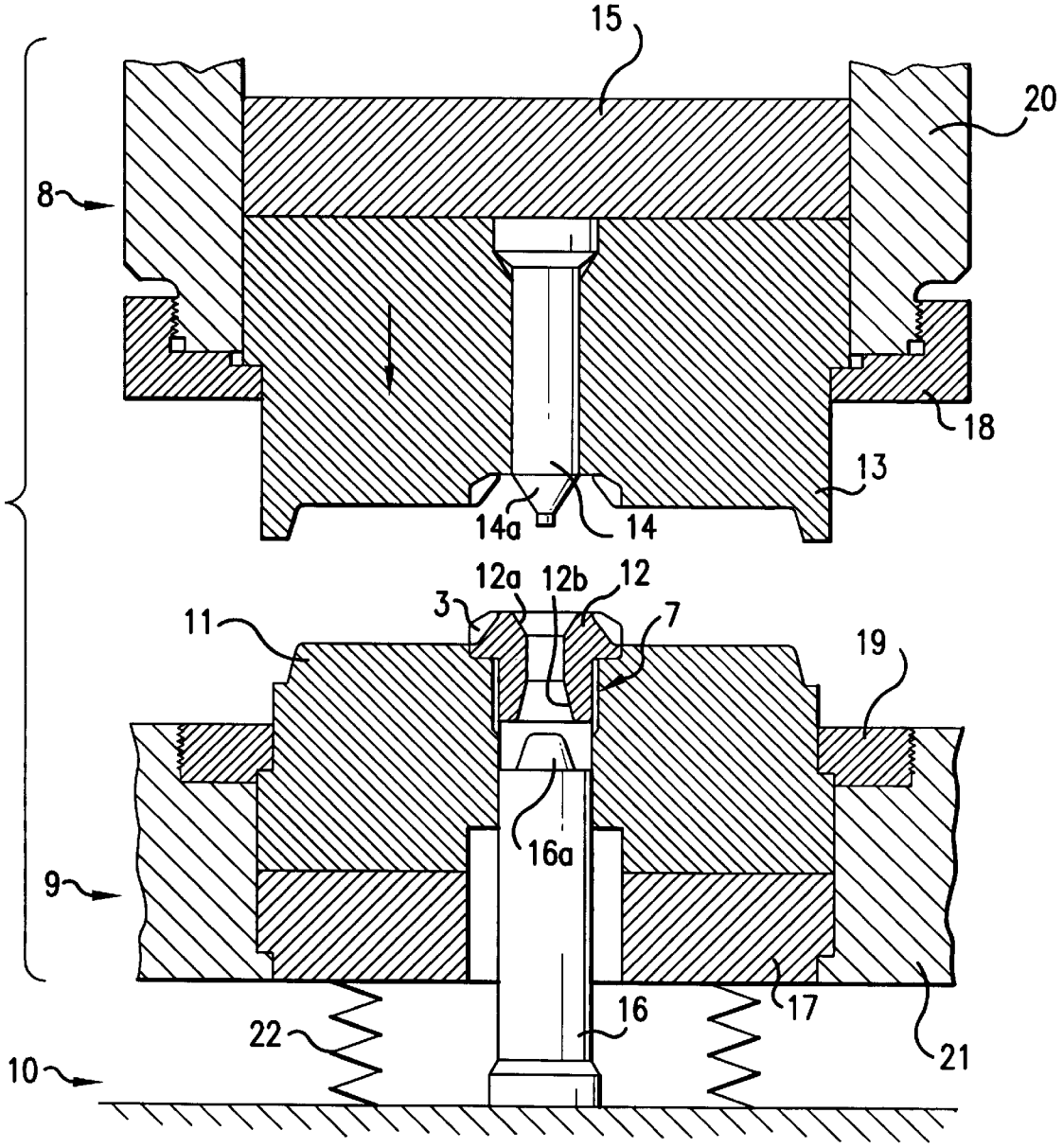
FIGS. 4–6 are cross-sections illustrating the sequence of steps for forging a bevel gear by a second method. The bevel gear before forging is shown in FIG. 4, the bevel gear during forging is shown in FIG. 5, and the bevel gear after forging is shown in FIG. 6.

Referring now to FIG. 4, work piece 12 is oriented with a previously formed bevel gear portion 3 facing upward. A shaft portion 7 of work piece 12 in this orientation fits into lower die 11. The shape of lower die 11 is complementary to the desired final splined shaft shape. Upper die 13 is formed in a shape complementary to the bevel gear. Lower die assembly 9 is supported on a die cushion 22 which spans the space between lower plate 17 and a solid support surface 10. Lower punch 16 also rests on solid support surface 10. FIG. 4 shows this arrangement with work piece 12 in place but before the press is activated and the arrow shows the direction upper die assembly 8 will move once it is activated.

Figure 5:
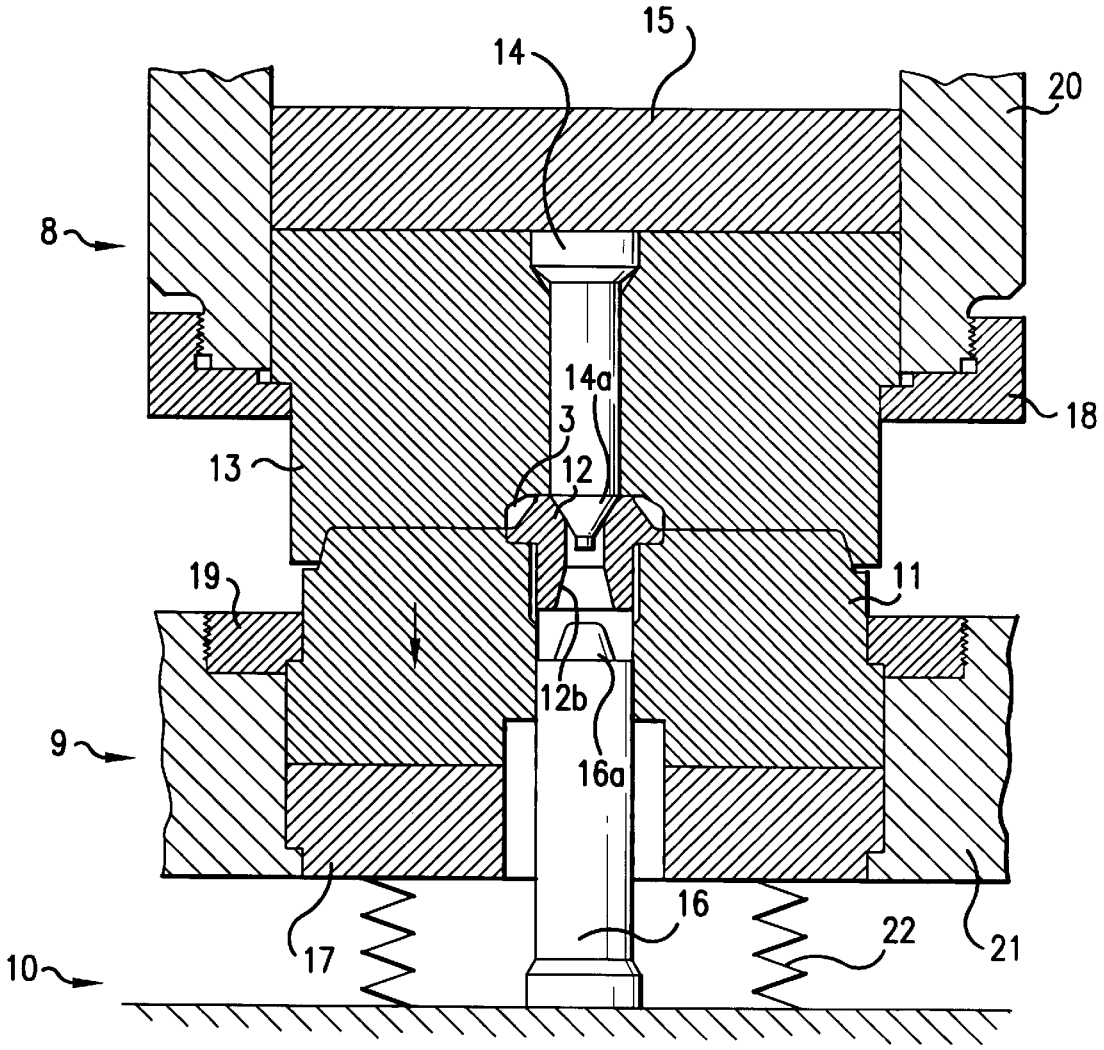

Referring now to FIG. 5, the press sequence is activated and the forging process is in progress. Upper die assembly 8 is lowered in the direction of the arrow to contact lower die assembly 9. Work piece 12 is in high pressure contact, as determined by the pressure in die cushion 22, with upper die 13. A conical surface 14*a* of upper punch 14 has exerted a deforming pressure on an upper inner conical surface 12*a* of work piece 12. The high pressure contact of upper die 13 with the bevel gear portion 3 causes coining or prevents deformation thereof.

Figure 6:
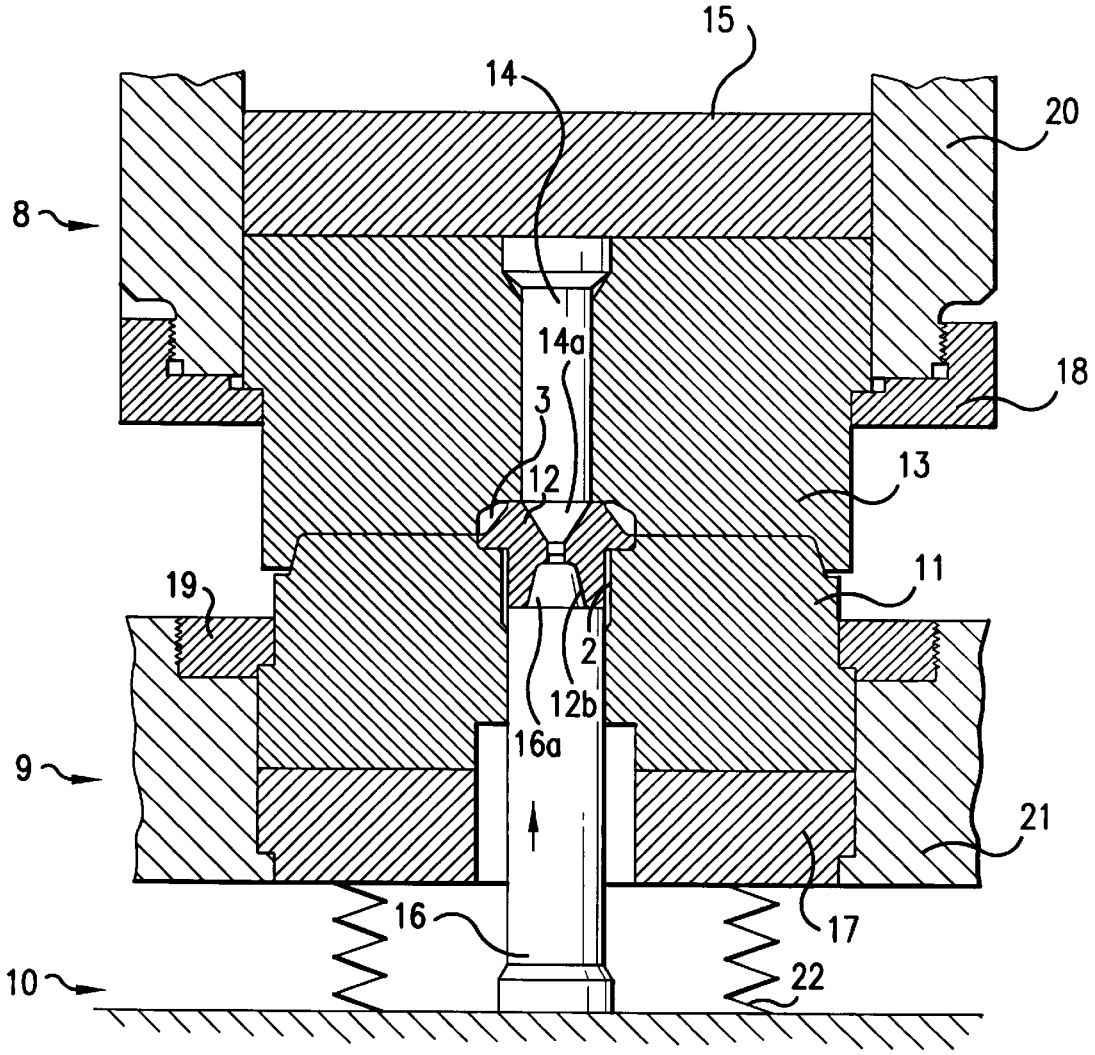

Referring now to FIG. 6, both upper and lower die assemblies 8 and 9 continue to move in the direction of the arrow. Stationary lower punch 16 having a conical surface 16*a* contacts inner conical surface 12*b* of work piece 12 exerting a second deforming pressure thereon. This second deforming pressure causes the material of work piece 12 to flow outward and fill all the voids of lower die 11, thereby forming the involute splines on the shaft of work piece 12.

Figure 7:
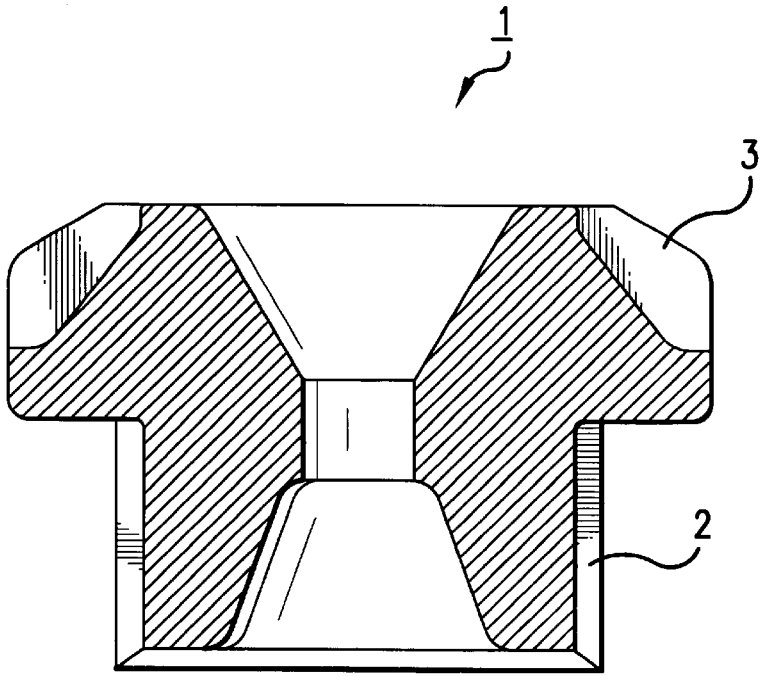
FIG. 7 is a cross-section of a bevel gear produced by the method of the present invention.
Figure 8:
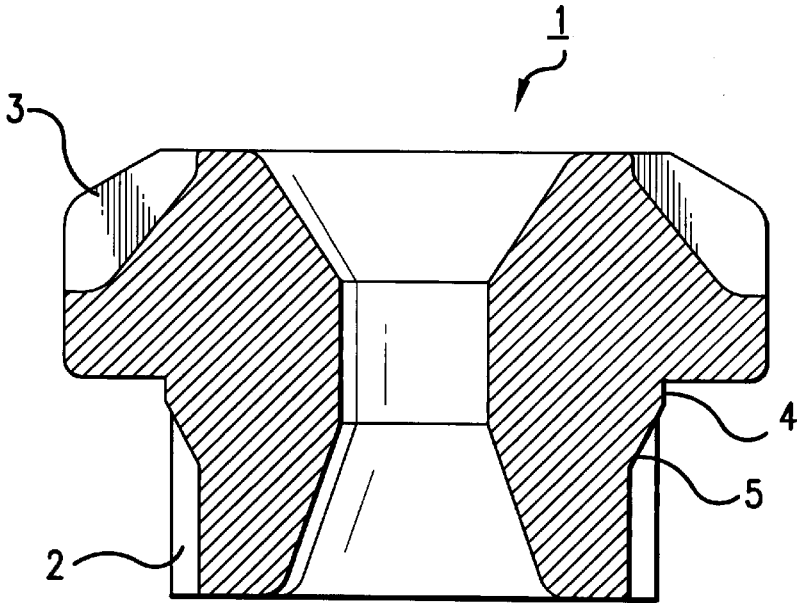
FIG.8 PRIOR ART
FIGS. 8 & 9 are cross sections of bevel gears produced by prior art methods.
Figure 9:
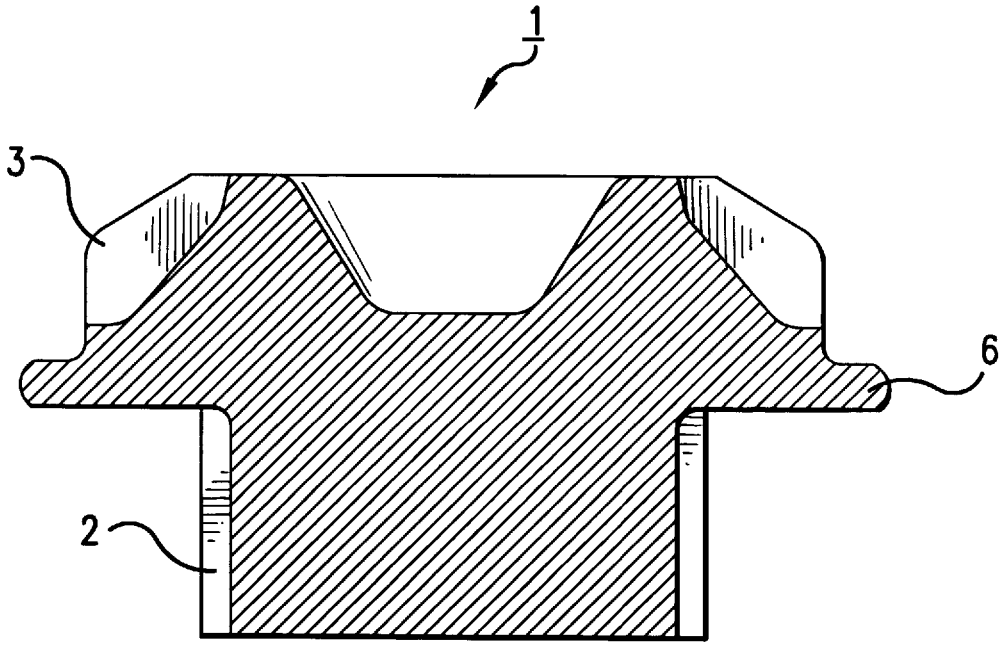
FIG.9 PRIOR ART

Referring now to FIG. 7, splines 2 are disposed the length of the shaft of bevel gear 1. In this example, a chromium-molybdenum steel (SCM415) is utilized as the raw material. A hydraulic cylinder is used as a die cushion. The pressure exerted between upper die 13 and lower die 11 is defined as 150 tons, while lower punch 16 received a pressure of 200 tons. It took 4 seconds to produce an involute spline gear portion by the method of this example compared to 5 minutes production time by a pinion cutter of the prior art. Also, the invention increased the yield rate on the product weight by approximately 7%.

Other configurations are possible by rearranging the orientation of the dies and punches. The coining process is not necessary in this invention. Moreover, it is possible to use a work piece without a central inner space.

We claim:

1. A method for fully-enclosed die forging of a bevel gear shaft, comprising the steps of:

providing an upper die having an upper punch and an upper plate;

providing a lower die having a lower punch and a lower plate, said lower die having a shaft formation hole in a center portion thereof, said shaft formation hole having a shape and size complementary to a finished bevel gear shaft;

providing a blank raw material having a bevel gear portion and a shaft portion, said shaft portion of said blank having a smaller diameter than said finished bevel gear shaft whereby said shaft portion is insertable in said shaft formation hole:

inserting said shaft portion into said shaft formation hole;

peripherally supporting said bevel gear portion in said lower die against downward and lateral movement;

urging said upper die downward, as a unit with said upper punch and said upper plate, to contact said blank in said lower die;

pressing together said upper die and said lower die into a clamped state, clamping and effecting one of a coining of and a prevention of deformation of said bevel gear portion; and while maintaining said clamped state, urging said lower punch upward causing an upward compression of said shaft portion wherein said raw material is outwardly bulged to a shape conforming to that of said shaft formation hole.

2. The method of claim 1, wherein:

said step of providing a lower die includes spline forming teeth formed in said lower die over an entire vertical length of a side wall of said shaft formation hole; and said step of urging said lower punch upward to effect outward bulging of said raw material to a shape conforming to that of said shaft formation hole results in forging splines on an entire length of said finished bevel gear shaft.

3. The method of claim 1, wherein:

the step of mounting includes said raw material being a hollow body;

an upper part of an inner surface of said hollow body is shaped to match said upper punch;

a lower part of said inner surface of said hollow body is shaped to match said lower punch; and said step of urging said lower punch upward causing said upward compression of said shaft portion includes excess raw material flowing into a hollow space between said upper and said lower punch.

4. A method for fully-enclosed die forging of a bevel gear shaft, comprising the steps of:

providing an upper die having an upper punch, said upper punch having a fixed position relative to said upper die;

providing a lower die having a shaft formation hole, said lower die resting on a die cushion, and said die cushion resting on a base;

providing a lower punch fixed to said base and aligned with said shaft formation hole whereby said lower die can move downward about said lower punch;

providing a blank raw material having a bevel gear portion and a shaft portion, said shaft portion of said blank having a smaller diameter than said finished bevel gear shaft whereby said shaft portion is insertable in said shaft formation hole, said lower die including support means for peripherally supporting said bevel gear portion against downward and lateral movement;

mounting said blank raw material by inserting said shaft portion into said shaft formation hole of said lower die, and peripherally engaging said bevel gear with said support means;

urging said upper die with said upper punch downward to contact said blank raw material;

pressing said upper die and said lower die into a clamped state, to effect one of a coining of and a prevention of deformation of said bevel gear portion;

urging said upper die further downward causing said lower die to move downward about said lower punch, against a counter-resistive force exerted by said die cushion, said upper die and said lower die being held in said clamped state by said counter-resistive force from below resulting from said resistance to compression of said die cushion, whereby an upwardly directed compressive force is exerted on said shaft portion by said lower punch acting as a stop against downward movement of said blank raw material sufficient to effect an upward compression of said raw material, thereby causing said raw material to outwardly bulge and conform to the shape of said shaft formation hole.

5. A method for fully-enclosed die forging of a bevel gear shaft, comprising the steps of:

providing a preformed blank of raw material having a shaft portion and a bevel gear portion;

providing a lower plate and a lower die having a lower punch, said lower die having a concavity formed on a central portion of said lower die for engaging with said bevel gear portion preformed on said raw material;

providing an upper plate and an upper die having an upper punch;

providing a shaft forming hole disposed at a central position of said upper die having spline forming teeth over a vertical length of a side wall of said shaft forming hole, said upper die including support means for peripherally supporting said bevel gear portion against upward and lateral movement;

said shaft portion of said raw material is inserted into said shaft forming hole of said upper die so that said bevel gear portion engages the lower die, and supportably engages said support means in said upper die;

said lower die and said lower die punch and said lower plate are urged upward, said upper die and said lower die are pressed together, and said bevel gear is forced into a clamped state, which operation effects one of a coining and a prevention of deformation of said bevel gear portion;

while maintaining said clamped state, said upper punch is urged downward causing a downward compression of said shaft portion, whereby said shaft portion is outwardly bulged forcing said raw material to conform to an interior shape of said shaft forming hole.

* * * * *